US009636935B2

(12) United States Patent
Thayer

(10) Patent No.: US 9,636,935 B2
(45) Date of Patent: May 2, 2017

(54) SYSTEM AND METHOD FOR CLEANING AN IMAGE RECEIVING SURFACE IN AN INKJET PRINTER

(71) Applicant: Xerox Corporation, Norwalk, CT (US)

(72) Inventor: Bruce E. Thayer, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 34 days.

(21) Appl. No.: 14/638,460

(22) Filed: Mar. 4, 2015

(65) Prior Publication Data

US 2016/0257148 A1 Sep. 8, 2016

(51) Int. Cl.
*B41J 29/17* (2006.01)

(52) U.S. Cl.
CPC ..... *B41J 29/17* (2013.01)

(58) Field of Classification Search
CPC ..... B41J 2/005; B41J 29/17
See application file for complete search history.

(56) References Cited

U.S. PATENT DOCUMENTS 3,468,248 A 9/1969 Giori
2003/0156868 A1 8/2003 Shin et al.
2009/0317555 A1* 12/2009 Hori ..... B41J 2/0057 427/428.06
2010/0251916 A1* 10/2010 Peles ..... G03G 15/11 101/492
2012/0256979 A1* 10/2012 Gordon ..... B41J 2/17593 347/5

FOREIGN PATENT DOCUMENTS

EP 0 858 010 A1 8/1998
EP 2 075 648 A2 7/2009
EP 2 281 691 A1 2/2011
JP GB 1244901 A * 9/1971 ..... G03G 21/0088
JP S58-82277 A 5/1983
JP 2004-271833 A 9/2004

* cited by examiner

*Primary Examiner* — Kristal Feggins
*Assistant Examiner* — Kendrick Liu
(74) *Attorney, Agent, or Firm* — Maginot Moore & Beck LLP

(57) ABSTRACT

A printer cleaning device cleans an image receiving surface treated with a surface preparation material. The cleaning surface includes an applicator that receives fluid from a receptacle and applies a portion of the fluid onto the image receiving surface of a printer. A wiper engages the image receiving surface to remove a portion of dried aqueous ink and fluid from the image receiving surface. The applicator is rotated in a direction opposite to a direction of movement of the image receiving surface. The dried aqueous ink and fluid removed by the wiper are diverted to a conduit to enable a pump to move the dried aqueous ink and fluid through a filter before returning the filtered fluid to the receptacle so the applicator can absorb the filtered fluid.

10 Claims, 5 Drawing Sheets

SYSTEM AND METHOD FOR CLEANING AN IMAGE RECEIVING SURFACE IN AN INKJET PRINTER

TECHNICAL FIELD

This disclosure relates generally to systems for cleaning image surfaces in printers, and more particularly, to systems for cleaning image surfaces in printers that treat image receiving surfaces with surface preparation materials.

BACKGROUND

Some inkjet printing systems or printers that treat image receiving surfaces with surface preparation materials include a cleaning device to remove certain materials from an image surface without removing all of the surface preparation material for the next printing cycle. Surface preparation material is any substance applied to support the image receiving surface to enable an ink image to be formed and to facilitate in the transfer of the ink image to media. Examples of a surface preparation material or a blanket coating include, but are not limited to, a skin coating, a fluid coating, a combination thereof, or the like. In some previously known systems, a blade cleaner is used to remove materials from the image surface. The materials removed from an image surface to replenish the ability of the image surface to form quality images include ink, surface preparation substances, media debris, and the like. Blade cleaners are effective because they can provide higher pressures on the imaging surface, but these pressures can result in a shorter life of the image forming surface and the blade cleaner. These drawbacks of using a blade cleaner increase the operating costs of operating the printer system.

To address the issues related to blade cleaners, some previously known aqueous ink printing systems have used a foam roller that rotates against the movement of the surface to be cleaned to scruff and carry material away from the surface. In aqueous ink printing systems, the image receiving surface that is cleaned by the foam roller is a blanket of material wrapped around an endless support surface, such as a rotating drum or belt. To enhance the surface properties of the blanket so ink adheres to it during image formation and then releases the ink image during transfer to media, the blanket is treated with a surface preparation material that forms a skin on the blanket surface. This surface preparation material is applied to the surface of the blanket after the ink image has been transferred to media and the blanket surface has been cleaned of the skin and residual ink from the previous imaging cycle. Ideally, the pressure of the foam roller should split and remove the ink layer while only hydrating the skin layer so it can be replenished. If the pressure applied to the blanket by the foam roller is too high, however, the thin skin layer under the ink layer also splits. This splitting of the skin layer enables some of the loosened ink to contact the blanket surface, which has an affinity for the ink. Consequently, the ink adheres to the blanket surface and is harder to remove than ink on the skin preparation material. Thus, the cleaning of the blanket is adversely impacted and image quality can be affected in subsequent imaging cycles.

In certain previously known aqueous ink printing systems, the ink is dried to a semi-wet consistency to enable the transfer of the ink image onto media before the imaging surface is cleaned by the cleaning device. In most cases, the semi-wet ink is easier to clean since the density of the ink is small. However in certain cases, the ink is over-dried.

Over-dried ink can occur regularly in machine operation due to machine faults. For example, faults such as media handling faults, control faults and other situations can result in the machine shutting down during the printing operation. The processing of these faults can leave the ink image under the dryers longer than desired. The extra drying can over dry the ink and make the dried ink harder to clean. Over drying can also reduce efficiency of the ink image transfer to the media causing a larger amount of the harder-to-clean ink to be introduced to the cleaning device in the printer system. To compensate for the occurrence of these situations, a blade cleaner may be employed rather than a foam roller cleaner since the blade cleaner can apply the higher pressures required to remove dried ink with the attendant risks noted previously.

FIG. 5 is a graph illustrating the effect that drying the aqueous ink on the image forming surface to various degrees has on the cleaning performance. Particularly, the effect of drying the ink on a blanket surface was tested on the load of a blade cleaner. Line 504 in FIG. 5 represents an over-dried ink, line 508 represents a semi-wet ink, and line 512 represents undried ink. The vertical axis of the graph in FIG. 5 represents the blade load in g/cm and the horizontal axis of the graph represents the blade working angle in degrees. In previously known aqueous ink printing systems, machine operators resort to isopropyl alcohol soaked rags to remove the over dried ink rather than using water alone. However, as seen in the graph in FIG. 5, the effort required to clean rises significantly when cleaning over dried ink 504 from a blanket by hand. As such, improvements in inkjet printers that enable cleaning of the imaging surface are desirable.

SUMMARY

A printer cleaning device has been configured to enable the removal of material from a cleaning surface of a printer. The printer cleaning device is included in a printing system that treats an image receiving surface with a surface preparation material. The printer cleaning device includes an applicator configured to receive fluid from a source of fluid, an actuator operatively connected to the applicator, a wiper configured to engage the image receiving surface after the image receiving surface has passed by the applicator, and a controller operatively connected to the actuator. The controller is configured to operate the actuator to apply fluid to the image receiving surface selectively to enable the wiper to remove the fluid and material from the image receiving surface.

A new method of cleaning that enables removal of material from a an image receiving surface with a surface preparation material. The method includes operating an actuator with a controller to move an applicator into contract with the image receiving surface to apply fluid to the image receiving surface selective. The method further includes wiping the image receiving surface with a wiper after the image receiving surface has passed the applicator to enable the wiper to engage the image receiving surface and remove material from the image receiving surface.

BRIEF DESCRIPTION OF THE DRAWINGS

The foregoing aspects and other features of a printer cleaning device that enables the removal of a material are explained in the following description, taken in connection with the accompanying drawings.

DETAILED DESCRIPTION

Figure 1:
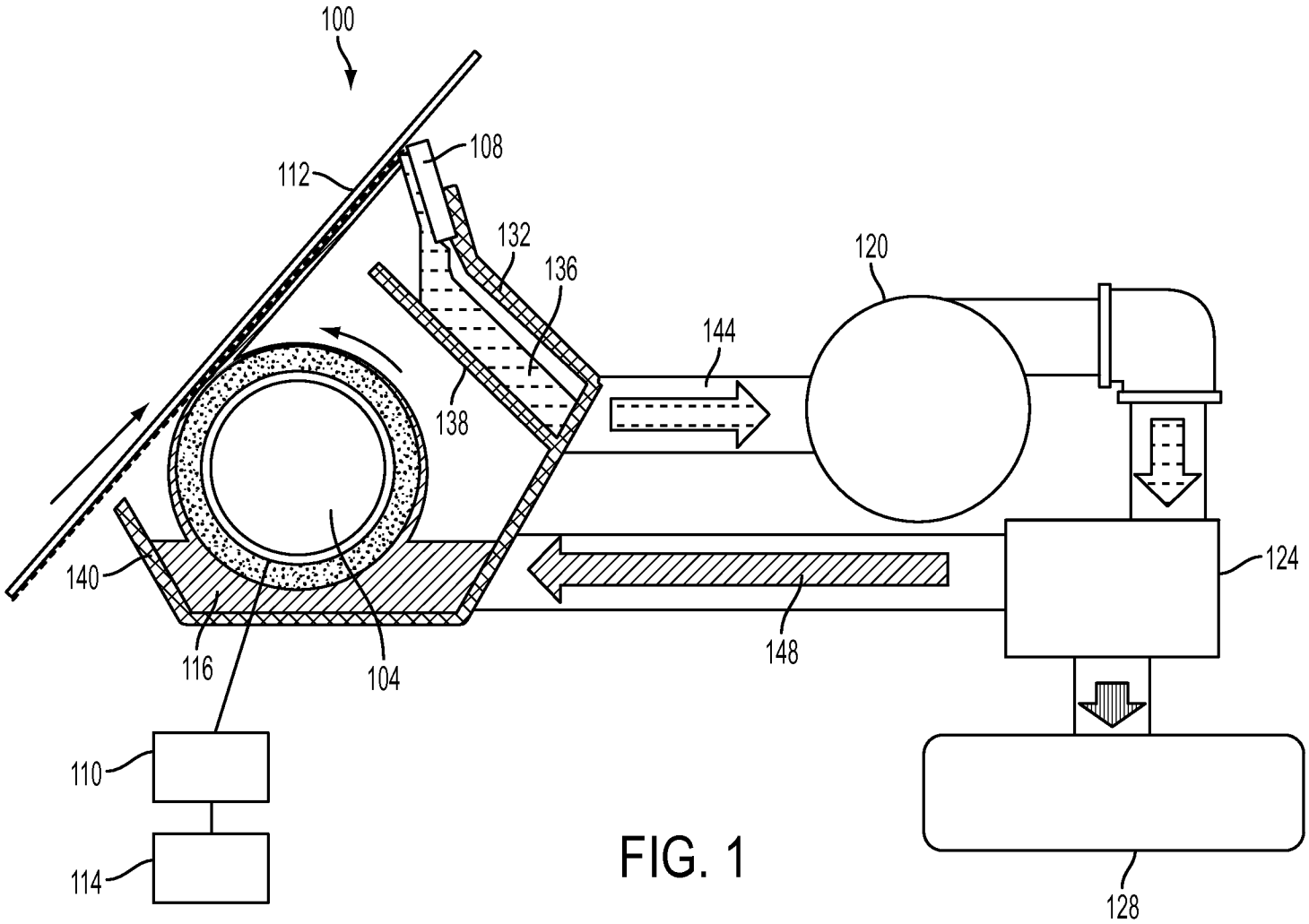
FIG. 1 illustrates an exemplary cleaning device.

For a general understanding of the present embodiments, reference is made to the drawings. In the drawings, like reference numerals have been used throughout to designate like elements.

FIG. 1 illustrates an exemplary cleaning device 100 used in a printer that treats an image receiving surface with a surface preparation material. The printer cleaning device 100 includes an applicator 104 that sits within a receptacle 140 to absorb fluid 116. The applicator 104 remains in contact with the surface of blanket 112 and applies a portion of the fluid 116 onto the blanket 112 to hydrate the materials on the surface of the blanket 112. The pressure applied by the applicator 104 is sufficient to hydrate the materials on the surface of the blanket 112 but it is not sufficient to split the skin layer and enable loosened ink to attach to the surface of the blanket 112.

Materials can be any substance that is carried by the surface of the blanket 112 after the blanket 112 passes through the nip that transfers an image to media. Examples of materials on the surface 112 include, but are not limited to, aqueous ink, semi-dried aqueous ink, surface preparation material layers or skin layers, debris, combinations thereof, or the like Ink can be any substance applied to the image receiving surface to produce an image that is transferred to media. Fluid 116 can be any substance that hydrates a material such as ink or a surface preparation material. Examples of the fluid 116 include, but are not limited to, water, a solvent, a dilate solution of a solvent with water, or the like. Examples of the applicator 104 include, but are not limited to, a foam pad, a foam roller, a sprayer, or the like to enable the fluid to be wiped or sprayed onto the surface of the blanket 112. In the illustrated embodiment, an actuator 110 is operatively connected to the applicator 104 and a controller 114 is operatively connected to the actuator 110 to operate the actuator 110 and rotate the applicator 104 in a direction opposite to the motion of the surface of the blanket 112. Alternatively, the applicator 104 can be a free rolling roller that rotates in the direction of movement of the blanket 112. In another example, the applicator 104 can be an open cell foam roller positioned inside the receptacle 140 so that it is saturated with water inside the receptacle and the applicator 104 rotates to apply the water to the surface of the blanket 112.

A wiper 108 contacts the surface of the blanket 112 with sufficient force to dislodge the hydrated materials from the surface of the blanket 112 so they can be carried away from the blanket by the fluid on the blanket that builds against the wiper. The wiper 108 is fixed at a predetermined angle with the blanket 112. In one example, the predetermined angle is 75 degrees, although other angles can be useful depending upon the properties of the materials being removed from the surface of the blanket. The wiper 108 can also dry the surface of the blanket to some degree. Examples of the wiper 108 include, but are not limited to, an elastomeric blade, a Polyurethane blade such as Synztec 238707 70 Shore A durometer, a xerographic blade, a higher durometer polyurethane blade, a urethane blade, other elastomers, or the like.

In the operation of the cleaner 100 shown in FIG. 1, the controller 114 operates the actuator 110 to move the applicator 104 and compress it against the surface 112 as the actuator 110 rotates the applicator 104 in a direction opposed to the direction of movement of the blanket 112. When the applicator 104 is moved out of contact with surface 112, the applicator 104 expands and absorbs a portion of the fluid 116 and the hydrated ink from the surface of the blanket 112. As the blanket 112 continues past the applicator 104, it reaches the wiper 108, which applies the blade with sufficient pressure to remove the hydrated ink and the skin layer with the fluid applied to the blanket 112. This combination of materials 136 flows off or drips onto a wall 138 that divides the volume of housing 132 into two chambers. The wall 138 diverts the removed combination 136 to a conduit 144 at the bottom of one of the chambers of the housing 132.

A pump 120 forces the removed combination 136 through the conduit 144 and the filter 124 to separate the ink and surface preparation material from the fluid 116. The filtered fluid 148 is returned to the receptacle 140. In one example, a portion of the fluid 116 is lost during the filtration process, for example, due to evaporation. As such, additional fluid 116 from another source (not shown) can be provided to the source 140. The separated materials from the filter 124 can be collected for disposal within, for example, the filter 124, a filter media inside the filter 124, a separate container 128, or the like.

The filter 124 can provide micro-filtration, ultra-filtration, nano-filtration, reverse osmosis, combinations thereof, or the like to separate the materials from the combination 136. The filter 124 can include a porous filter media having very small pore sizes to separate the materials from the combination 136. In one example, different filter medias of varying pore sizes can be used to filter different materials from the combination 136. For example, the filter 124 includes very small pore sizes such as a pore size of about less than 0.01 μm. The filter 124 also includes a skin filter having a pore size of about less than 10 μm. A larger pore size may be required to filter the skin because the components of the skin are larger and can clog the pores required to filter ink. In another example, a series of progressively smaller pore size filters are positioned inside the filter 124 to efficiently separate different materials from the combination 136. The reader should understand that these parameters are exemplary and other pore sizes or filter materials can be used to separate the materials from the combination 136. In one example, the pump 120 can be operated in reverse to pull filtered fluid from the receptacle 140 and through the filter 124 to back-flush the filter and remove filtered materials from the filter media to enable reuse of the filter media. Alternatively, the filter can be back-flushed with other techniques that include, but are not limited to, using a machine, an external reclamation process, or removing and washing the filter media.

Figure 2:
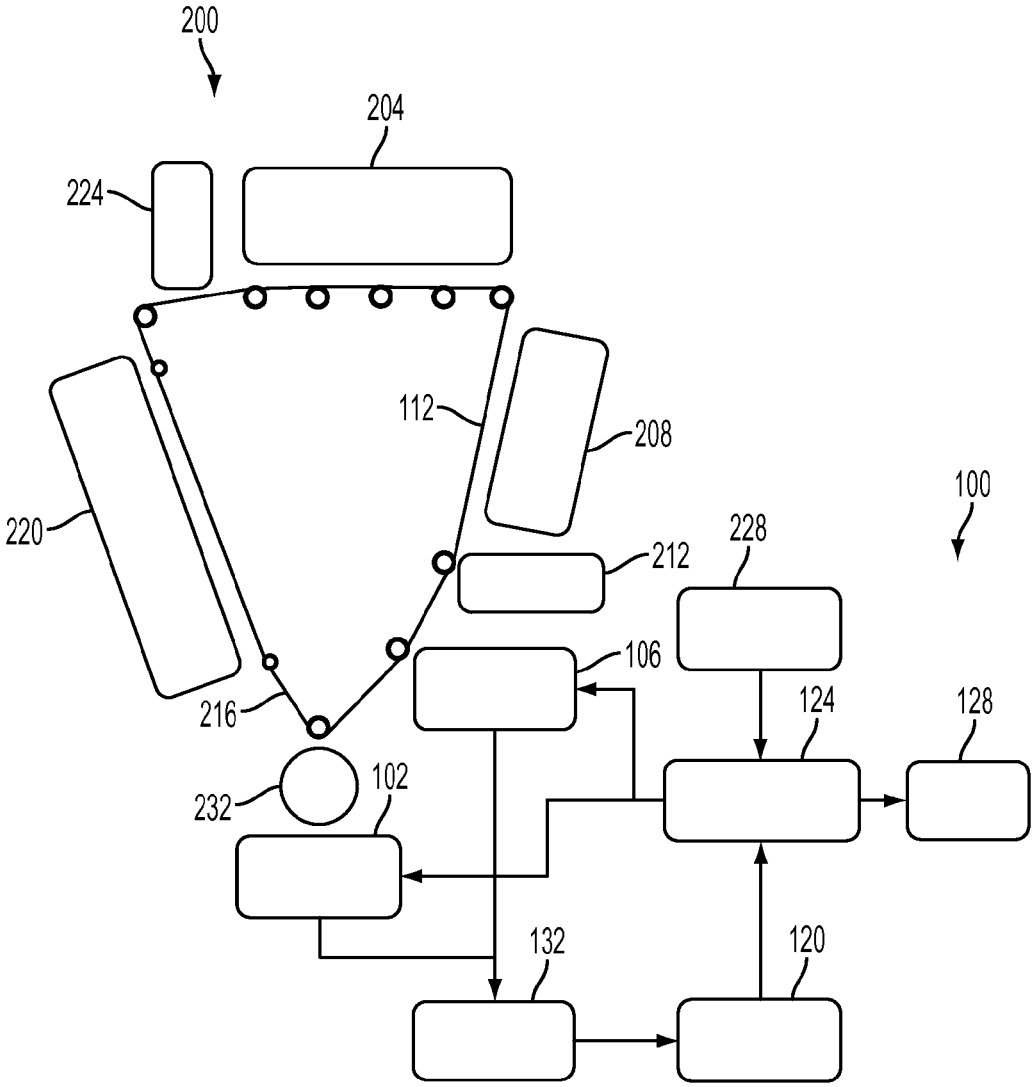
FIG. 2 illustrates an exemplary printer system in which the exemplary cleaning device is used.

FIG. 2 illustrates an exemplary printer system 200 in which the exemplary cleaning device 100 is used. A coater 212 applies a layer of surface preparation material that forms a skin on the surface of the blanket 112. The blanket 112 and the applied material are dried to a certain degree using a dryer 208. Dryer 208 can be implemented with, but not limited to, an air knife, a heated dryer that directs air or heat onto the blanket 112, combinations thereof, or the like. The blanket 112 passes through an imager 204 that deposits ink onto the surface of the blanket 112 to form an ink image.

Another dryer 220 is used to dry the ink image to a certain degree. The partially dried ink image 216 then enters a nip formed by the blanket 112 and the transfer roller 232 to transfer the ink to media synchronized to pass through the nip as the ink image passes through the nip. The blanket 112 then passes through a portion 106 of the cleaning device 100, which is similar to the applicator, receptacle and wiper of the cleaner 100 described above. The applicator deposits fluid onto the image receiving surface and a wiper removes fluid and ink from the blanket as described above. The diverted fluid and material are collected in waste sump 132 and a pump 120 pulls the removed fluid and material from the sump 132 and urges it through a filter 124 to remove the ink and skin material, which is sent to waste collector 128. The filtered fluid is returned to the receptacle of the cleaning portion 106. The filter 124 also receives clean fluid 116 from fluid source 228 to back-flush the separated materials from the filter and direct them into waste container 128. Transfer roller maintenance system 102 applies cleaning fluid to transfer roller 232 and removes residual material from the roller that is collected in waste sump 132 to be filtered with the fluid and material collected from the cleaning portion 106.

Figure 3:
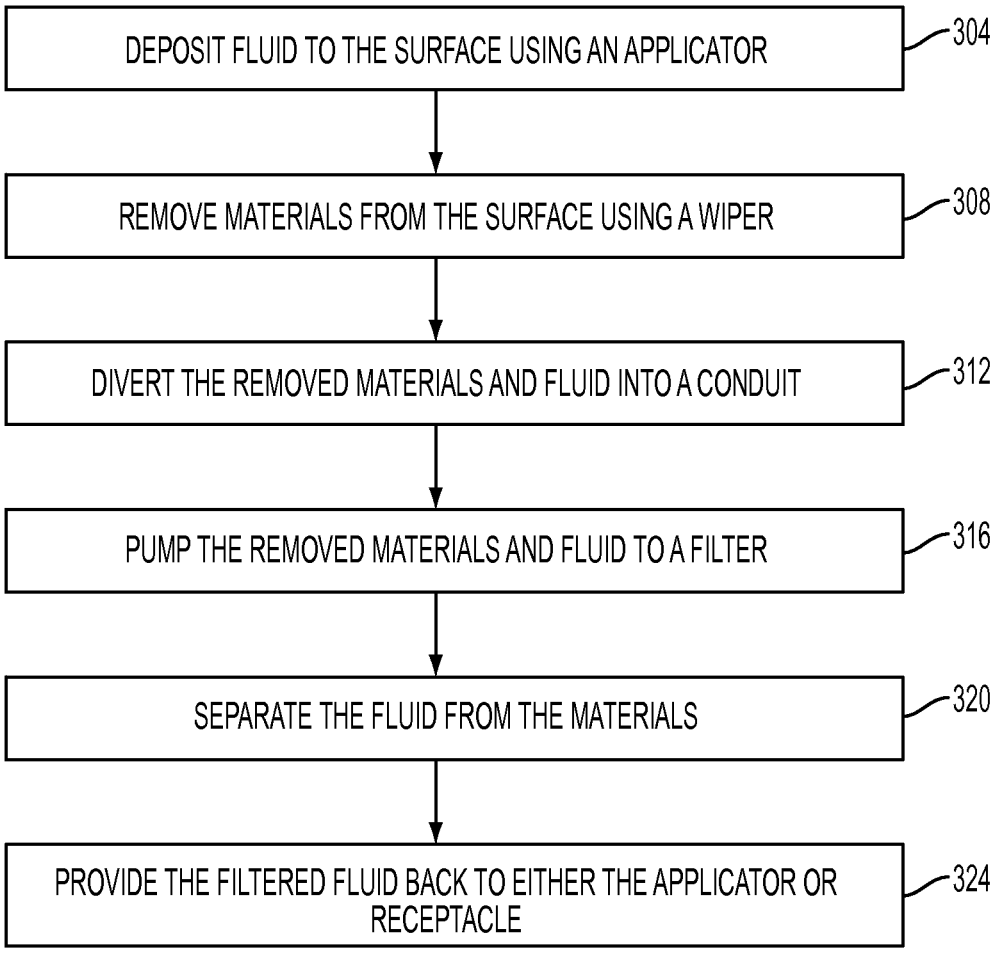
FIG. 3 illustrates an exemplary process of using a cleaning device.

FIG. 3 illustrates an exemplary process of using a cleaning device 100. An applicator 104 receives fluid 116 from receptacle 140. A controller 114 operates an actuator 110 to move the applicator 104 into contact with a surface of the blanket 112. The applicator 104 deposits a portion of the fluid 116 onto the blanket 112 (Step 304). The deposited fluid 116 hydrates materials on the surface 112. A wiper 108 removes the hydrated materials and fluid 116 from the surface of the blanket 112 (Step 308). The removed fluid and materials are collected and diverted into a conduit 144 (Step 312). A pump 120 is used to move the removed fluid and materials from the conduit 144 and the housing 132 to a filter 124 (Step 316). The filter 124 separates the fluid 116 from the materials (Step 320). The filtered fluid 116 is provided back to the receptacle 140 (Step 324). The separated materials are then removed for disposal.

Figure 4:
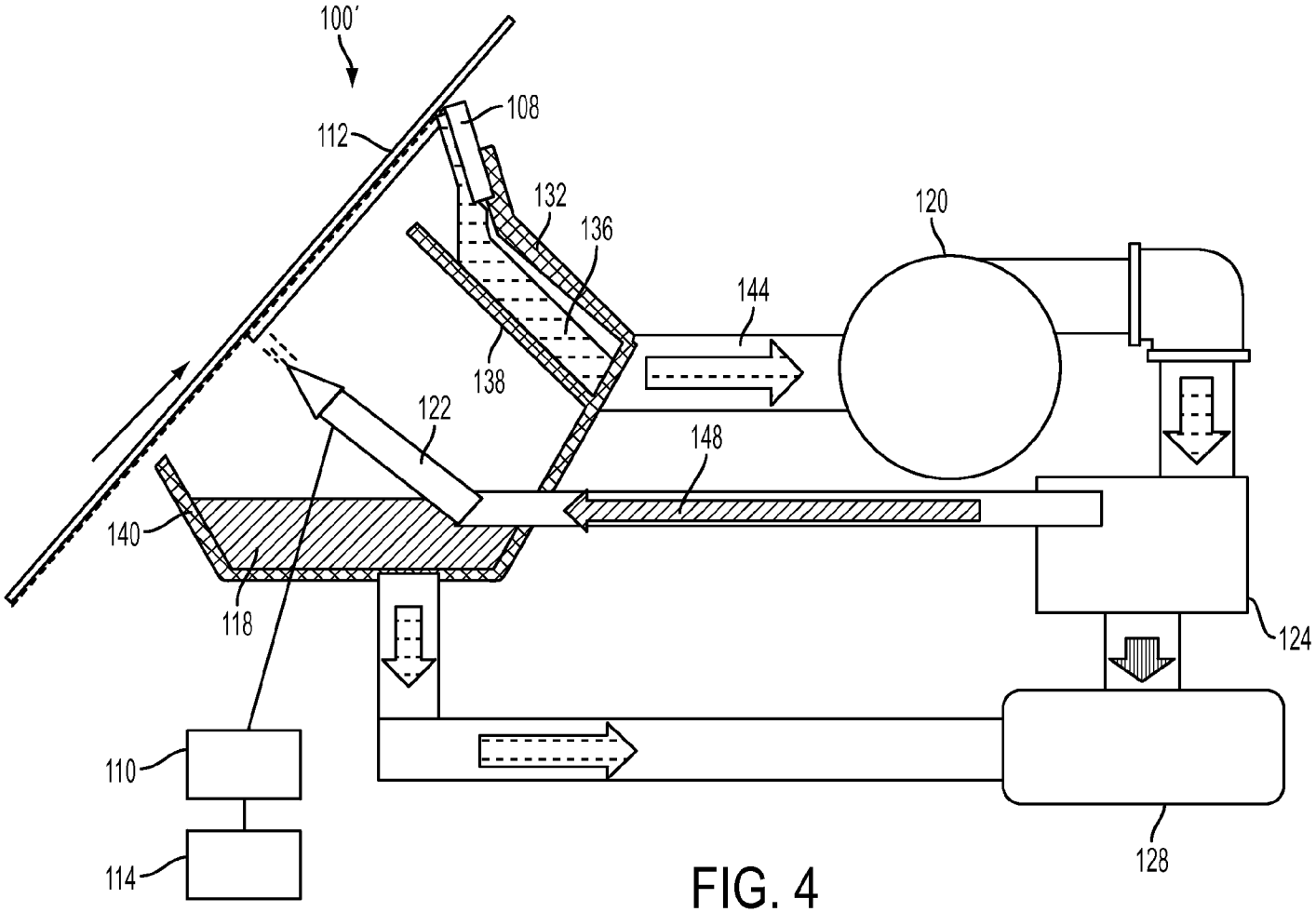
FIG. 4 illustrates an alternative embodiment of the cleaning device shown in FIG. 1.
Figure 5:
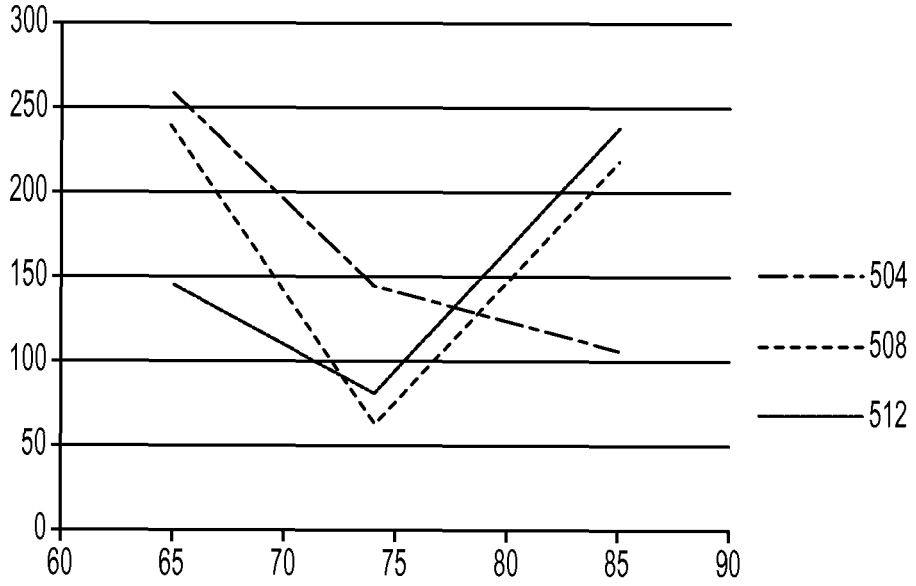
FIG. 5 is a graph illustrating the effect that drying the ink on the blanket to various degrees has on the cleaning performance.

FIG. 4 illustrates an alternative embodiment 100' of the cleaning device used in a printer that forms images with ink. The printer cleaning device 100' includes a sprayer 122 that sits within a receptacle 140 to catch fluid 118 that may drip from the blanket 112. The fluid 118 can be provided back to the pump 124 for filtering or to the waste receptacle 128. The sprayer 122 sprays fluid 148 onto the blanket 112 to hydrate the materials on the surface of the blanket 112. The pressure of the sprayed fluid is sufficient to hydrate the materials on the surface of the blanket 112 but it is not sufficient to split the skin layer and enable loosened ink to attach to the surface of the blanket 112. In the illustrated embodiment, an actuator 110 is operatively connected to the sprayer 122 and a controller 114 is operatively connected to the actuator 110 to operate the sprayer. A wiper 108 contacts the surface of the blanket 112 with sufficient force to dislodge the hydrated materials from the surface of the blanket 112 so they can be carried away from the blanket by the fluid on the blanket that builds against the wiper. The wiper 108 is fixed at a predetermined angle with the blanket 112 as noted above to remove hydrated materials and fluid from the blanket 112. This combination of materials 136 flows off or drips onto a wall 138 that divides the volume of housing 132 into two chambers. The wall 138 diverts the removed combination 136 to a conduit 144 at the bottom of one of the chambers of the housing 132. A pump 120 forces the removed combination 136 through the conduit 144 and the filter 124 to separate the ink and surface preparation material from the fluid 148. The filtered fluid 148 is returned to the sprayer 122.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer cleaning device included in a printing system that treats an image receiving surface with a surface preparation material, the cleaning device comprising:

a receptacle configured to hold fluid, the receptacle having a wall positioned within the receptacle to divide the receptacle into a first chamber and a second chamber;

an applicator positioned in the first chamber of the receptacle to absorb fluid into the applicator;

an actuator operatively connected to the applicator;

a wiper configured to engage the image receiving surface after the image receiving surface has passed by the applicator; and a controller operatively connected to the actuator, the controller being configured to operate the actuator to move the applicator selectively into engagement with the image receiving surface to apply fluid from the first chamber of the receptacle to the image receiving surface with the applicator and enable the wiper to remove the fluid and material from the image receiving surface as the image receiving surface moves from a position opposite the applicator to a position opposite the second chamber in the receptacle without moving outside of a perimeter of the receptacle to divert fluid and material removed from the imaging surface by the wiper into a conduit that communicates with the second chamber in the receptacle and to operate the actuator to move the applicator out of engagement with the image receiving surface.

2. The printer cleaning device of claim 1 further comprising:

a pump fluidly connected to the conduit communicating with the second chamber in the receptacle to move fluid and material from the second chamber through the conduit and into the first chamber of the receptacle.

3. The printer cleaning device of claim 2 further comprising:

a filter positioned between the pump and the first chamber of the receptacle to separate material from the fluid prior to the fluid entering the first chamber of the receptacle.

4. The printer cleaning device of claim 3, wherein the filter is further configured to provide at least one of micro-filtration, ultra-filtration, nano-filtration, and reverse osmosis to separate material from fluid.

5. The printer cleaning device of claim 3, the filter further comprising:

a porous material.

6. The printer cleaning device of claim 2, the controller being further configured to operate the actuator to rotate the applicator in a direction opposite to the direction in which the image receiving surface moves.

7. The printer cleaning device of claim 1, the applicator further comprising:

one of a foam roller and a foam pad.

8. The printer cleaning device of claim 1 further comprising:

an air knife or a heated dryer positioned to direct air or heat, respectively, towards the image receiving surface to remove fluid from the image receiving surface after the image receiving surface has passed the wiper.

9. The printer cleaning device of claim 1, wherein the wiper is formed with a material that consists essentially of an elastomer.

10. The printer cleaning device of claim 1, wherein the fluid consists essentially of water or a combination of water and a cleaning solution.

* * * * *